US008328119B2

(12) United States Patent
Grether

(10) Patent No.: US 8,328,119 B2
(45) Date of Patent: Dec. 11, 2012

(54) WATER OUTLET FOR A LOW-PRESSURE SANITARY OUTLET FITTING

(75) Inventor: Hermann Grether, Muellheim (DE)

(73) Assignee: Neoperl GmbH, Muellheim (DE)

( * ) Notice: Subject to any disclaimer, the term of this patent is extended or adjusted under 35 U.S.C. 154(b) by 251 days.

(21) Appl. No.: 12/668,591

(22) PCT Filed: Apr. 24, 2008

(86) PCT No.: PCT/EP2008/003290

§ 371 (c)(1),
(2), (4) Date: Jul. 15, 2010

(87) PCT Pub. No.: WO2009/006956

PCT Pub. Date: Jan. 15, 2009

(65) Prior Publication Data

US 2010/0282869 A1 Nov. 11, 2010

(30) Foreign Application Priority Data

Jul. 12, 2007 (DE) ..... 20 2007 009 836 U

(51) Int. Cl.

| | |
|---|---|
| ***E03C 1/084*** | (2006.01) |
| ***E03C 1/08*** | (2006.01) |
| ***B05B 1/32*** | (2006.01) |
| ***B05B 1/30*** | (2006.01) |

(52) U.S. Cl. ..... 239/428.5; 239/453; 239/456; 239/459; 239/460

(58) Field of Classification Search ..... 239/428.5, 239/435, 452, 453, 456, 459, 460, 462, 506, 239/507, 514, 518, 524, 541, 569–571, 575, 239/583, 590.5; 138/37, 43–46

See application file for complete search history.

(56) References Cited

U.S. PATENT DOCUMENTS

| | | | | |
|---|---|---|---|---|
| 2,990,123 | A * | 6/1961 | Hyde | 239/453 |
| 4,313,564 | A | 2/1982 | Shames et al. | |
| 6,126,093 | A | 10/2000 | Grether et al. | |
| 2008/0251604 | A1 | 10/2008 | Schmid | |

FOREIGN PATENT DOCUMENTS

| | | | |
|---|---|---|---|
| DE | 38 17 270 | A1 | 11/1989 |
| DE | 10 2004 044 158 | B3 | 1/2006 |

OTHER PUBLICATIONS

International Preliminary Report on Patentability (Seven (7) pages).
International Search Report with English Translation dated Aug. 29, 2008 (Four (4) pages).
PCT/IS/237 with partial English translation (Eight (8) pages).
PCT/IPEA/409 with partial English translation (Fifteen (15) pages).

* cited by examiner

*Primary Examiner* — Darren W Gorman
(74) *Attorney, Agent, or Firm* — Crowell & Moring LLP

(57) ABSTRACT

A water outlet for a low pressure sanitary outlet fitting has a perforated structure which is air-permeable counter to the water outlet direction and, in the unpressurized state, holds water in the outlet direction, and has a plurality of through-flow holes. At least one bypass is provided, which bypasses the perforated structure and has an opening cross section which is larger than the throughflow holes. A bypass valve is movable from a closed position into an open position counter to a resetting force as a consequence of an increase in pressure on the inflow side. If a hot water tank connected upstream of the water outlet fitting increasingly contracts as the heated water therein cools, air can nevertheless be sucked in via the perforated structure and the pressure can be equalized. If excessive pressures builds up with the heating of the water in the hot water tank, the bypass valve moves from a closed position into an open position counter to a resetting force.

15 Claims, 3 Drawing Sheets

WATER OUTLET FOR A LOW-PRESSURE SANITARY OUTLET FITTING

This application is a national stage of PCT International Application No. PCT/EP2008/003290, filed Apr. 24, 2008, which claims priority under 35 U.S.C. §119 to German Patent Application No. 20 2007 009 836.7, filed Jul. 12, 2007, the entire disclosure of which is herein expressly incorporated by reference.

BACKGROUND AND SUMMARY OF THE INVENTION

The invention relates to a water outlet for a low pressure sanitary outlet fitting.

There already exist hot water tanks that are mounted under a wash basin within the framework of a decentralized hot water supply. Hot water tanks of this type are configured as unpressurized tanks that can be heated. Moreover, their volume can contract or expand as a function of the water temperature. The volume of the water located in the tank changes, as a result of which the water volume expands in the event that the water is heated.

The jet regulators, which are generally provided on the outlet end of a sanitary outlet fitting, have comparatively small holes, which are located, for example in the area of their jet divider and can be clogged by the dirt particles in the water. As a result, there is the risk that the outlet fitting can be closed so tightly that a dangerous pressure can build up in the water tank. Therefore, low pressure fittings do not usually use a standard jet regulator. Rather these low pressure fittings use jet regulators that have significantly larger flow cross sections. However, it is a particular drawback that in the event of temperature induced expansions and contractions in the water tank, the water column in the fitting can also change. Especially in the course of closing the outlet fitting, the water column, which is still standing in the fitting, will typically flow out of the fitting and continue to drip or flow, because the requisite free cross sectional area has to be dimensioned. This factor is usually perceived to be annoying.

An additional drawback with the commercially available low pressure jet regulators is that they often react in a sensitive way to an inflow sided flow that deviates from the axial symmetry, as is often the case with hand-held shower heads and cast iron fittings. The result is a poor and splashing non-homogeneous jet pattern.

German patent document DE 10 2004 044 158 B3 discloses a prior art water outlet mouthpiece having a switchable jet regulator insert, which has a cleaning jet channel and at least one flow chamber having a large number of water egress nozzles. At least one inflow aperture of the flow chamber is controllable by means of at least one valve, which is biased into its closed position, such that it can be opened by the water flowing in, by a predeterminable banking-up pressure of the water. For automatic switching between a sharply bundled cleaning jet (as is necessary, for example, for cleaning a razor) and a standard enlarged and especially aerated soft jet, a valve of the jet regulator insert that is provided in the water outlet mouthpiece known from the prior art has a valve piston that is axially displaceable in the direction of flow of the water and a valve disk, and has at least one water inlet aperture, which leads to the cleaning jet channel that extends through the hollow valve piston.

The cleaning effect, targeted in German patent document DE 10 2004 044 158 B3, assumes that the outlet fitting, known from the prior art, is a high pressure outlet fitting.

Moreover, the jet regulator insert provided in German patent document DE 10 2004 044 158 B3 does not have a bypass channel, which bypasses the perforated structure. And finally, the cleaning jet channel, which is provided in the jet regulator insert, known from the prior art, and which runs through the valve piston, is always open and precisely not switchable between on open and a closed position.

German patent document DE 38 17 270 A1 discloses a prior art jet regulator having a jet regulator housing, in whose passage channel is inserted a jet regulator insert. In order to reduce a backflow pressure, which builds up more and more as a result of dirt on the rear side of the insert, the passage cross section of the jet regulator can be enlarged upon exceeding a predeterminable backflow pressure, in that the jet regulator insert is released from its normal operating position and either falls out of the jet regulator housing or else passes into a triggering position, in which, for example, a ring channel, which enlarges the overall passage cross section, is formed around the insert.

The jet regulator insert, which is provided in the prior art jet regulator, known from German patent document DE 38 17 270 A1, is positioned in a standard operating position inside the passage cross section in such a way that the entire stream of liquid flows through the jet regulator insert, whereas, in contrast, the jet regulator insert is released in response to the triggering device and can then fall out in the outflow direction, in order to then totally release the passage channel until the jet regulator is exchanged or serviced.

U.S. Pat. No. 4,313,564 A discloses a prior art jet regulator, which has in the area of its jet divider a bypass channel with a bypass valve, which moves into its closed position as a consequence of a pressure increase on the inflow side. In contrast, when the water pressure is low, this bypass valve stays in its open position, so that dirt particles can be flushed out through the bypass channel. The bypass valve of the jet regulator, known from the prior art, is open in the unpressurized state or at low water pressure conditions and causes the perforated structure, which is provided in its area, to be not capable of holding precisely water in the unpressurized state.

Therefore, one object of the invention is to provide a water outlet of the type described, that is designed as an idle safety and is highly reliable.

This and other objects and advantages are achieved by the water outlet in accordance with the invention, which has a perforated structure that is permeable to air in a direction counter to the water outlet direction, and that, in the unpressurized state, holds water as a consequence of the surface tension. The flow holes of the perforated structure have a small flow cross section, in order to produce a surface tension that is adequate to hold the water column that remains in the outlet fitting, after the outlet valve of the outlet fitting has been closed, and to counteract an afterflow and idling of this water column. If the water tank increasingly contracts as the heated water cools down, then it is still possible to suck in air through the perforated structure and to equalize the pressure. If there is the risk that, as the temperature of the water supply increases, excessive pressure will build up (because, for example, the perforated structure is soiled by the dirt particles entrained in the water), a bypass having at least one bypass valve becomes operative. As a consequence of the associated pressure increase, the bypass valve is moved from its closed position into its open position counter to a resetting force and can bring about a decrease in pressure.

The water outlet in accordance with the invention can be permanently installed in a sanitary outlet fitting. In order, however, to be able to install the inventive water outlet simply and advantageously into a wide range of outlet fittings, it is practical to design the water outlet as an insert cartridge, which can be inserted into the outlet end of a sanitary outlet fitting.

In order to offer as little flow resistance as possible to the water jet that flows through, and to achieve the largest possible passage cross section in the areas of the perforated structure without losing adequate surface tension there, it is advantageous to design the perforated structure as a preferably honeycomb-like screen surface.

In one preferred embodiment of the invention the bypass is disposed centrally in the perforated structure so that the latter, (which may also be designed, if required, as a screen surface) surrounds the central bypass in a ring shape.

It is especially advantageous if the bypass valve has a closing element that is guided moveably along the narrow edges of flow guide walls, preferably surrounding and extending radially outward from in a radiating manner the closing element. The flow guide walls, which are disposed radially not only form a reliable sliding guide around the closing element of the bypass valve, but can also readily shape the water emerging from the water outlet to form a homogenous, non-splashing composite jet.

In order to avoid the generation of any undesired turbulence and any unnecessary flow resistance in the water by the closing element (around which flows the water that is flowing through), it is advantageous to design the closing element in the shape of a ball, spherical segment or mushroom and with a subarea that tapers off in the direction of flow.

Working on this basis, in a preferred embodiment of the invention, the closing element is designed at least in certain areas as a segment of a sphere (hereinafter referred to as a "spherical segment"), so that, when the bypass valve is in the closed position, a base proportional of the spherical segment closes the valve port of the bypass valve. In this embodiment, the closing element with its spherical segment extends as far as up to the individual jets produced by the flow holes of the perforated structure. This embodiment is characterized by a low resistance and homogeneous jet guide and formation.

In order not to set the closing element, guided in the water outlet, into an undesired and noise-generating oscillation, and in order to be able to guide the closing element in an easily moveable manner and yet with minimum play in the water outlet, it is advantageous if the closing element includes a guide pin, which is disposed preferably on the outflow side, and is guided displaceably in a guide sleeve that is held stationarily in the water outlet. At the same time the guide pin and the guide sleeve are guided along narrow contact lines with comparatively low friction, if the guide sleeve has a polygonal and preferably hexagonal inside guide cross section, in which the guide pin having a round outer cross section is displaceably guided.

In order to be able to move the closing element with as little trouble as possible against a constant reset force, it is advantageous if the closing element is moveable against the reset force of at least one return spring.

The formation of a homogeneous composite jet in the water outlet in accordance with the invention is assisted if the flow holes are enclosed by flow guide walls. So that these flow guide walls can easily fulfill their jet guiding function in an especially effective way, it is advantageous if the flow holes have a flow length that is smaller than their inside flow cross section or, if need be, the same size. This feature offers advantages with respect to a better jet pattern especially if the incoming flow is at an angle.

So that the water outlet in accordance with the invention can safely lower an undesirably high pressure, and so that this safety function is not negatively affected by operating errors (for example, by closing the water outlet with the palm of the hand, the finger tips or a plane surface), it is advantageous if the outflow side peripheral rim area of the cartridge housing is designed in an approximately crown shaped or crenellated manner, by outward formations and inward formations.

Additional features of the invention are apparent from the following description of the embodiments of the invention in conjunction with the claims and the drawings. The individual features may be realized in each case by themselves or in any combination in the case of an embodiment according to the invention.

DETAILED DESCRIPTION OF THE DRAWINGS

Figure 1:
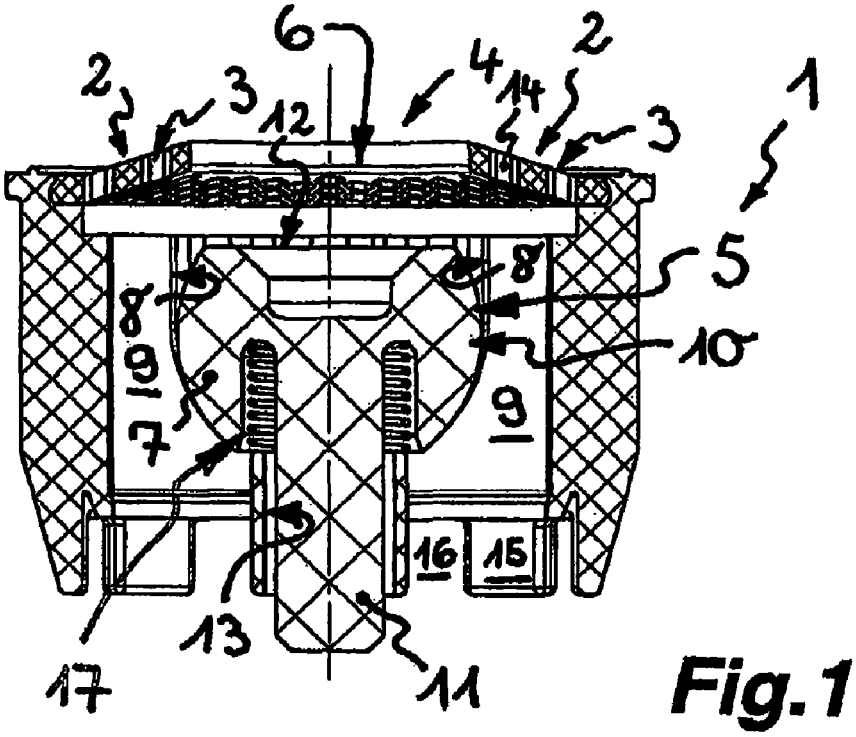
FIG. 1 is a longitudinal cross sectional view of a water outlet, which comprises an insert cartridge, has a perforated structure on the inflow side, and has a central bypass, the water outlet being designed in this case as an idle safety, for preventing the water column from idling when this water column remains in a low pressure sanitary fitting after the fitting has been closed.
Figure 2:
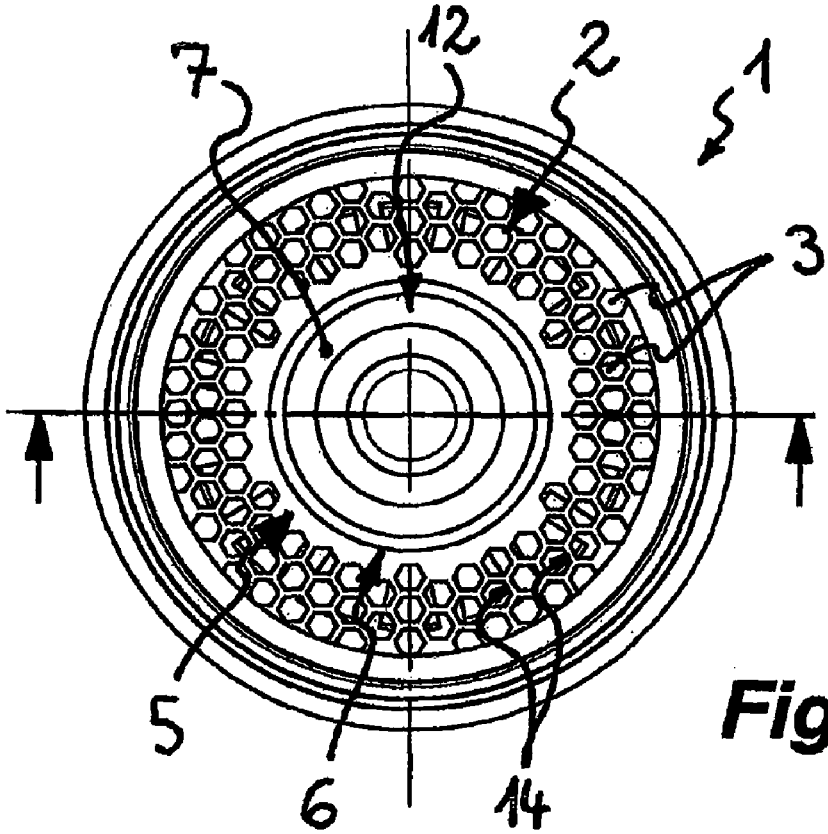
FIG. 2 is a top view of the inflow side perforated structure of the water outlet FIG. 1, with the bypass positioned in the open position, as in FIG. 1.

FIG. 1 to 6 show a water outlet 1, which is designed to prevent the water column that remains in the fitting, from idling after the low pressure fitting (which is intended to be connected to an unpressurized water tank) has been closed. In this case this water outlet 1 is provided in the form of an insert cartridge that can be mounted on the outlet end of the outlet fitting via a conventional outlet mouthpiece (not illustrated in detail).

The illustrated insert cartridge, which serves as an idle safety, is necessary, for example, in hot water tanks that are mounted under a wash basin in a decentralized hot water supply. Such hot water tanks are designed as heated, unpressurized tanks, the fill volume of which can contract or expand as a function of the water temperature. In the course of this process the volume in the hot water tank changes so that, if the temperature of the water is increased, the volume of water expands.

In the case of temperature induced expansions and contractions in the hot water tank, the water column that remains in the outlet fitting can also change.

The water outlet 1 has a perforated structure 2 that is permeable to air counter to the water outlet direction, and produces a surface tension. The flow holes 3 of this perforated structure 2 have a small flow cross section that produces a surface tension adequate to hold the water column remaining in the outlet fitting after the outlet valve has been closed, in the outlet fitting, and to counteract an afterflow and idling of such water column. If in the outlet fitting the water column associated with the hot water tank begins to contract more and more as the heated water cools down, then it is still possible to suck in air through the perforated structure 2 and to equalize the pressure. If, on the other hand, there is still a risk that, as the temperature of the water supply in the hot water tank increases, excessive pressure will build up (because, for example, the perforated structure 2 is soiled by the dirt particles entrained in the water), a bypass 4, which is provided in the water outlet 1, and its bypass valve 5 become operative. As a consequence of this pressure increase, the bypass valve is moved from its closed position into its open position counter to a resetting force and can bring about a decrease in pressure. In this case the resetting force is brought about by a return spring 17.

It is evident from FIG. 1 to 5 that the perforated structure 2 is designed as a honeycomb-like screen surface with flow holes 3 that have a hexagonal cross section (FIG. 4) and offer the water that is flowing through as little flow resistance as possible. In this context the bypass 4 is arranged coaxially to the longitudinal center axis, and a valve port 6 of the bypass valve 5 is enclosed by the inner peripheral edge of the annular circumferential perforated structure 2.

The outflow side of the perforated structure 2 includes the closing element 7 of the central bypass valve 5, which is guided movably along the narrow edges 8 of radially arranged flow guide walls 9. (See FIGS. 5 and 6.) The latter surround and extend radially outward from the closing element 7 and are preferably evenly spaced in the circumferential direction. The flow guide walls 9 form not only a reliable sliding guide around the closing element 7, but can also readily shape the water issuing from the water outlet 1, into a homogeneous composite jet.

In one embodiment of the invention, the closing element 7 is designed approximately in the shape of a mushroom. On its inflow side it has a spherical segment-shaped subarea 10, to which is molded on its outflow side a cylindrical guide pin 11. When the bypass valve 5 is in its closed position (FIG. 3), the base 12 of the spherical segment-shaped subarea 10 of the closing element 7 closes the valve port 6 of the bypass valve. In this position, the spherical periphery of the spherical segment-shaped subarea 10 extends up to the individual rays, which are produced by the flow holes 3 of the perforated structure 2. Thus, the closing element 7, around which flows the stream of water that is flowing through, promotes a low resistance and homogeneous jet guide and formation in the water outlet 1.

The guide pin 11, molded on the closing element 7, is guided displaceably in a guide sleeve 13 that is arranged coaxially to the longitudinal center axis of the water outlet 1. The guide sleeve 13 is designed as an insert cartridge and is connected as one piece to the narrow edges 8 of the flow guide walls 9, which extend inwardly at the outflow side. Since the cylindrical guide pin 11 has a round outside cross section and while the guide sleeve 13 has a polygonal (in this case hexagonal) inside guide cross section (FIG. 6), the guide pin 11 and the guide sleeve 13 are guided with comparatively low friction along narrow contact lines.

In order for the outlet 1, which is designed as an idle safety (and in this case as an insert cartridge), to be able to bring about, if required, a fast decrease in pressure, the valve port 6 of the bypass valve 5 has an opening cross section that is significantly larger than one of the flow holes 3 of the perforated structure 2. The flow holes 3 of the perforated structure 2 are delimited by flow guide walls 14 and have a flow length that is as long as their inside flow cross section. As a result, the flow guide walls 14 which surround the flow holes 3, can readily guide the individual jets, produced in the perforated structure 2, even in the case of a flow coming in at an angle. Thus, even more additional support is provided for a homogeneous jet guide in the water outlet 1.

The return spring 17, which acts on the closing element 7, surrounds the guide pin 11 and is supported on the guide sleeve 13. The flat front face 90 of the flow guide walls 9 is spaced apart from the perforated structure 2 in the axial direction, serving as an additional partial deflecting area and helping to form the jet. The flow guide walls 9 extend over a longitudinal area of the insert cartridge that is as large as possible, in order to help to impart to the water jet a concentric orientation after the water jet has issued from the water outlet, and in this way to help to give its shape an attractive appearance.

In order that the water outlet 1 safely decrease an undesired high pressure and in order that this safety function of the water outlet 1 is not negatively affected, for example, by a closing of the water outlet 1 by the palm of the hand, by the finger tips or by a plane surface, the outflow side peripheral edge area of the cartridge housing is designed in an approximately crown shaped (or "crenellated") manner by outward formations 15 and inward formations 16.

Figure 3:
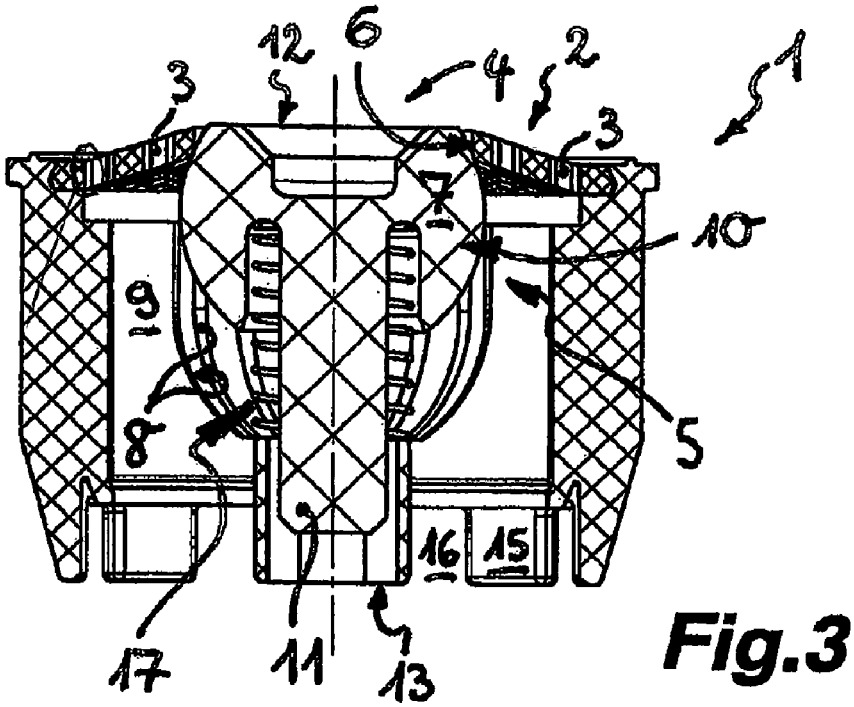
FIG. 3 is a longitudinal view of the water outlet from FIGS. 1 and 2, which is designed as an insert cartridge and is shown with its bypass valve in the closed position.
Figure 4:
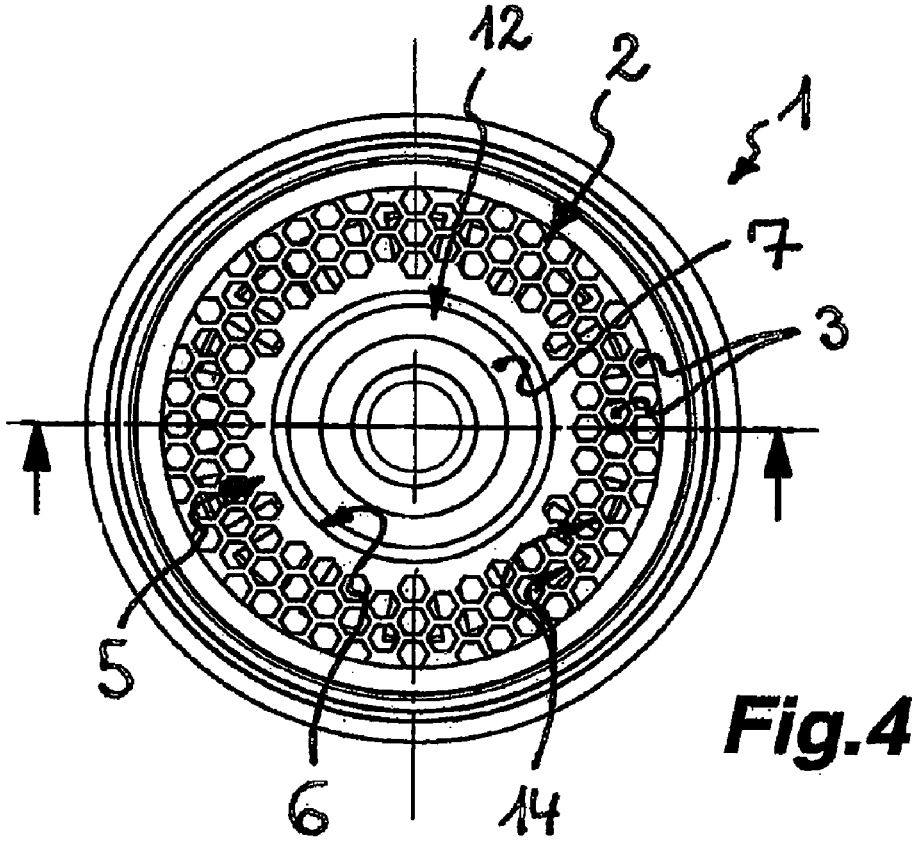
FIG. 4 is a top view of the inflow side perforated structure of the water outlet from FIG. 1 to 3, with the central bypass and its bypass valve in its closed position.
Figure 5:
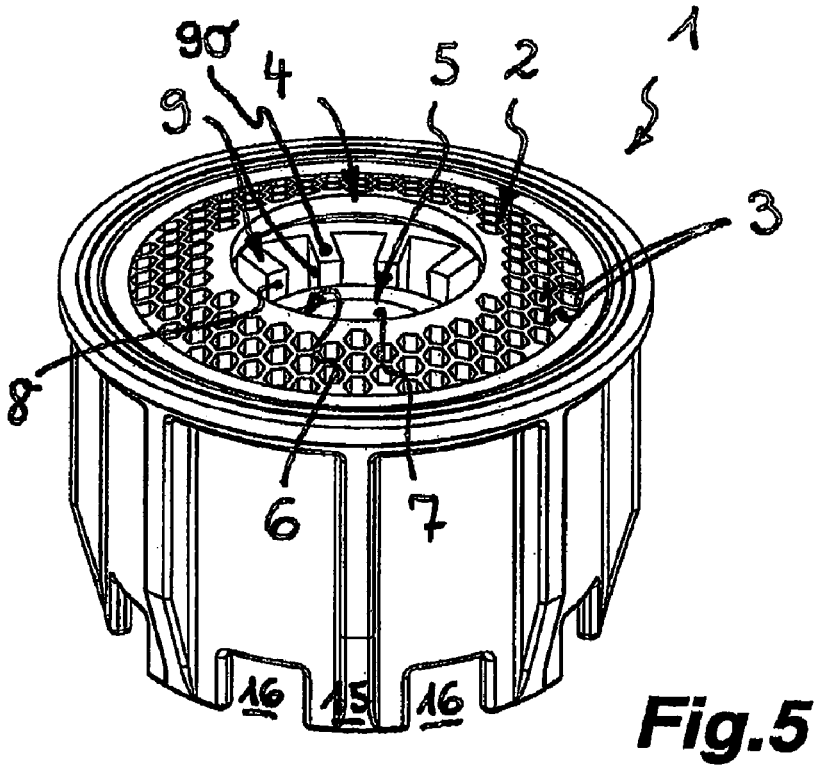
FIG. 5 is a perspective top view of the inflow side of the water outlet from FIG. 1 to 4.
Figure 6:
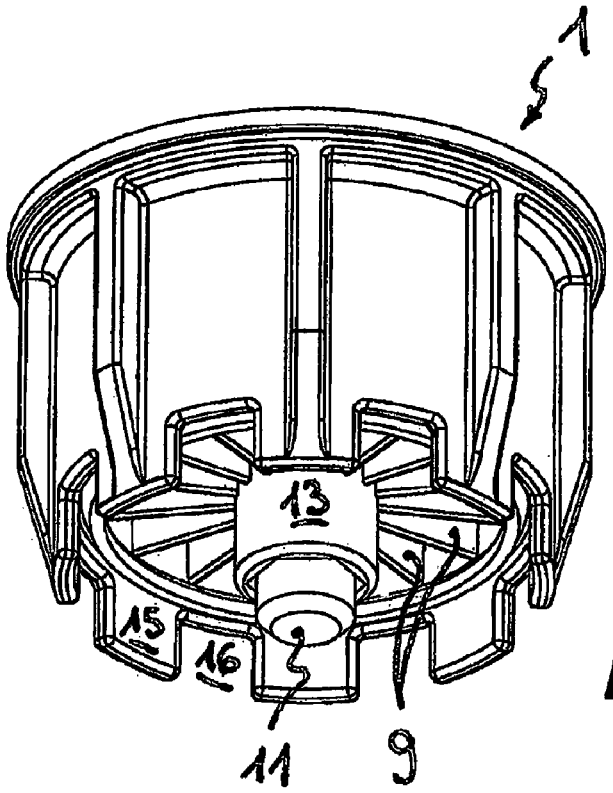
FIG. 6 is a perspective top view of the outflow side of the water outlet from FIG. 1 to 5.

Working on this basis, the length of the guide pin 11 is dimensioned so long that, even if the outflow end of the guide pin closes flush with the guide sleeve 13, the bypass valve 5 is still not in its closed position shown in FIG. 3.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A water outlet for a low pressure sanitary outlet fitting, said water outlet comprising:

a perforated structure element having a perforated structure that has a plurality of flow holes, and retains water in an outlet direction of the water outlet when the water outlet is in an unpressurized state;

at least one bypass that bypasses the perforated structure and has an opening cross section that is larger than that of one of the flow holes; and a bypass valve, that is movable from a closed position in which it closes off said bypass, into an open position counter to a resetting force as a consequence of an increase in pressure on an inflow side of said water outlet, wherein the perforated structure element is configured with respect to the bypass so that the perforated structure element is permeable to air external to the water outlet in a direction counter to the outlet direction when the bypass valve is in the opened and closed positions.

2. The water outlet as claimed in claim 1, wherein the water outlet is provided in the form of an insert cartridge, which can be inserted into the outlet end of a sanitary outlet fitting.

3. The water outlet as claimed in claim 1, wherein the perforated structure has a honeycomb-like screen surface.

4. The water outlet as claimed in claim 1, wherein the at least one bypass is disposed centrally in the perforated structure element.

5. The water as claimed in claim 1, wherein the bypass valve has a closing element, which is guided moveably along narrow edges of radially disposed flow guide walls that surround the closing element.

6. The water outlet as claimed in claim 5, wherein the closing element is formed as one of a sphere, spherical segment, and mushroom, and has a subarea that tapers off in a flow direction.

7. The water outlet as claimed in claim 5, wherein:

the closing element is designed at least in certain areas as a spherical segment;

a base portion of the spherical segment closes a valve port of the bypass valve when the bypass valve is in the closed position; and the closing element with its spherical segment extends as far as up to individual jets that are produced by the flow holes of the perforated structure.

8. The water outlet as claimed in claim 5, wherein the closing element has a guide pin, which is disposed on an outflow side thereof, and is guided displaceably in a guide sleeve.

9. The water outlet as claimed in claim 1, wherein the flow holes are delimited by flow hole walls.

10. The water outlet as claimed in claim 1, wherein the flow holes have a flow length that is smaller than or equal to their inside flow cross section.

11. The water outlet as claimed in claim 2, wherein an outflow side peripheral rim area of a housing of the cartridge is designed in an approximately crown shaped manner, by outward and inward formations.

12. The water outlet as claimed in claim 8, wherein an outflow end of the guide pin is disposed at a distance above an outflow side sleeve opening in the guide sleeve when the bypass valve is in the closed position.

13. The water outlet as claimed in claim 5, wherein a front face of at least one of said flow guide walls is spaced apart from the perforated structure in the outlet direction and is designed as a deflecting plate, which is flat in at least certain areas, for the inflowing water.

14. A water outlet for a low pressure sanitary outlet fitting, said water outlet comprising:

a cylindrical outer wall that defines an interior cylindrical water passage with an inflow end and an outflow end;

a perforated structure that is situated across said inflow end of said water passage, has a multiplicity of flow holes therein, and is permeable to air in a direction that is counter to a water flow direction in said water passage, said flow holes being of such a size as to retain water therein when said water outlet is in an unpressurized state;

a centrally situated opening in said perforated structure, said centrally situated opening having a diameter that is larger than a diameter of one of the flow holes, and providing a bypass for the flow holes when said centrally situated opening is not closed off;

a bypass valve that is spring biased in a closed position, in which a valve body closes off the centrally situated opening, said bypass valve being movable from said closed position into an open position in which said centrally situated opening is not closed off, in response to an increase in pressure at said inflow end.

15. The water outlet according to claim 14, further comprising:

a plurality of flow guide walls that extend radially inward from said cylindrical outer wall, within said interior cylindrical water passage; wherein, inward edges of said flow guide walls curve inwardly toward the outflow end of the water passage; and said inward edges guide movement of said valve body between said open and closed positions and provide a stop for said movement toward said outflow end of the water passage.

* * * * *